US010633176B2

(12) United States Patent
McKechnie

(10) Patent No.: US 10,633,176 B2
(45) Date of Patent: Apr. 28, 2020

(54) FLUID CONTAINMENT DEVICE

(71) Applicant: 2C Enviro Inc., Lloydminster (CA)

(72) Inventor: Kris McKechnie, Lloydminster (CA)

(73) Assignee: 2C ENVIRO INC., Lloydminster (CA)

( * ) Notice: Subject to any disclaimer, the term of this patent is extended or adjusted under 35 U.S.C. 154(b) by 0 days.

(21) Appl. No.: 16/276,062

(22) Filed: Feb. 14, 2019

(65) Prior Publication Data

US 2019/0248579 A1 Aug. 15, 2019

(30) Foreign Application Priority Data

Feb. 14, 2018 (CA) ..... 2995123

(51) Int. Cl.

*B65D 90/24* (2006.01)
*E02D 31/00* (2006.01)
*B65D 90/02* (2019.01)

(52) U.S. Cl.

CPC ..... *B65D 90/24* (2013.01); *B65D 90/023* (2013.01); *E02D 31/00* (2013.01); *E02D 2300/0009* (2013.01); *E02D 2300/0012* (2013.01)

(58) Field of Classification Search

CPC ..... B65D 90/24; B65D 90/023; E02D 31/00; E02D 2300/0009; E02D 2300/0012

See application file for complete search history.

(56) References Cited

U.S. PATENT DOCUMENTS 4,917,543 A 4/1990 Cole et al.
5,597,084 A * 1/1997 Parasin ..... B65D 11/1873 206/600
5,638,973 A * 6/1997 Dewey ..... B65D 11/1873 206/509
6,053,666 A 4/2000 Irvine et al.
7,708,495 B1 * 5/2010 Antee ..... E02B 3/108 405/111
9,039,325 B2 * 5/2015 McDowell ..... E02D 31/002 405/52
2007/0227094 A1 * 10/2007 Oscar ..... B65D 90/023 52/630
2010/0021236 A1 * 1/2010 Kreikemeier ..... E03F 1/005 405/55
2010/0329785 A1 * 12/2010 Nero ..... E06B 3/9642 405/16
2011/0139774 A1 * 6/2011 Nolan ..... B65D 19/18 220/4.28
2013/0108371 A1 * 5/2013 Marshall ..... B65D 90/24 405/114
2013/0277363 A1 * 10/2013 French ..... B65D 88/52 220/4.16
2014/0353310 A1 * 12/2014 Perkins ..... B65D 90/08 220/4.12

* cited by examiner

*Primary Examiner* — Carib A Oquendo
(74) *Attorney, Agent, or Firm* — Berg Hill Greenleaf Ruscitti LLP

(57) ABSTRACT

A containment basin comprising a plurality of interlocking modular panels, wherein said modular panel are free-standing. The interlocking modular panel for use in a containment basin, comprise: a base section; and a side section; wherein said base section panel and side section panel being fixedly connected to one another at an edge and comprising a plurality of rib elements bridging the side section and base section.

16 Claims, 5 Drawing Sheets

FLUID CONTAINMENT DEVICE

CROSS-REFERENCE TO RELATED APPLICATIONS

This application claims the benefit of and priority to Canadian Application No. 2,995,123, filed Feb. 14, 2018. The entire specification and figures of the above-referenced application is hereby incorporated in its entirety by reference.

FIELD OF THE INVENTION

This invention relates to fluid containment device, more specifically a fluid containment device which is free-standing to be used in oil and gas operations.

BACKGROUND OF THE INVENTION

Environmental issues abound in the oil and gas industry. A recurring concern for all stakeholders involved in this industry is the issue of spill containment. Containment basins have been developed as safeguards in the oil and gas industry between storage/operations and the environment. Current regulations in the industry require that storage operations provide secondary fluid containment because of environmental considerations.

Several types of containment basins have been developed and are being marketed in the industry. Typically, these containment basins consist of a plurality of wall sections arranged in a closed perimeter encircling an oil/gas storage unit. The wall sections are placed on an leveled surface and held in place by post, supports legs, tension cables, or the like. The interior section is typically covered with an impermeable plastic cover where the thickness varies. The plastic cover is then covered by sand, gravel or the like. The following prior art represents some of these devices.

U.S. Pat. No. 6,053,666 discloses an extruded containment barrier panel (5) for use in forming a containment barrier wall about a waste material storage or disposal site is disclosed. The containment barrier panel has an elongate body panel (10) with a top end (11), a spaced bottom end (12), and a first side edge (14) and a spaced parallel second side edge (15) extending from the top end to the bottom end of the body panel. A C-shaped female connecting member (17) is formed along the first side edge of the body panel, and a complimentary male connecting member (22) is formed along the second side edge of the body panel, both of which extend the length of the body panel. The male connecting member is sized and shaped to be slidably received within a second one of the female connecting members for forming an interlocked edge-standing relationship with a second one of the barrier panels, and both of the male and female connecting members may be rotated with respect to one another when one of the containment barrier panels is being joined to a second adjacent one of the containment barrier panels to form a containment barrier wall. The male connecting member has least two elongate seal members (32, 33, 34) extending the length thereof, and constructed and arranged to be placed into sealing engagement with the female connecting member of the second barrier panel such that a fluid-tight seal will be formed between adjacent ones of the barrier panels for preventing the migration of groundwater and/or underground gases from out or into the waste material storage or burial site.

U.S. Pat. No. 4,917,543 A teaches wall systems which employ a plurality of individual panels formed of extruded polymeric material joined in edge-to-edge relation including wale members which are vertically offset and interlocked at end portions thereof with adjacent wale members. The wall systems include connector elements for joining and interlocking the adjacent panel edges, and panels are disclosed, each having a continuous convex surface between their opposite side edges and strengthening ribs formed on a concave surface disposed opposite the convex surface thereof. A revetment system is disclosed in which a pair of wall sections are positioned in facing spaced-apart relation and joined by tie bolts extending through the wale members, to receive concrete therebetween.

Despite the known devices in the prior art, there still exists a need for strong yet easier to install containment basin which provide similar or better containment performance but allow for substantially decreased installation costs. The inventor has developed a novel modular panel system for use in containment basin which has eliminated the need/requirement for posts, support legs or the like in the installation process.

SUMMARY OF THE INVENTION

According to a first aspect of the present invention, there is provided a containment basin comprising a plurality of interlocking modular panels, wherein said modular panel are free-standing.

According to another aspect of the present invention, there is provided an interlocking modular panel for use in a containment basin, wherein said modular panel comprises:

a base section; and a side section;

wherein said base section panel and side section panel being fixedly connected to one another at an edge and comprising a plurality of rib elements bridging the side section and base section.

Preferably, each of one said plurality of ribs extends from said side section down to the base section. Preferably also, each one of said plurality of ribs being substantially perpendicular to the edge defined by the side section and base section. According to a preferred embodiment, each one of said plurality of ribs having an inward arcuate shape and each one of said plurality of ribs extending from a distance Y from the edge on the side section down to a distance X from the edge on the base section. Preferably, the length of distance Y is substantially equal to the length of distance X.

According to a preferred embodiment, the interlocking modular panel further comprises a plurality of shorter ribs, wherein each one of the plurality of shorter ribs is positioned between two adjacent rib elements in an alternating pattern. Preferably, each one of said plurality of shorter ribs having an inward arcuate shape and each one of said plurality of shorter ribs extending from a distance Y2 from the edge on the side section down to a distance X2 from the edge on the base section. Also preferably, the length of distance Y2 is substantially equal to the length of distance X2.

According to another aspect of the present invention, there is provided a containment basin comprising a plurality of interlocking modular panels forming a perimeter around a storage tank wherein said each one of said modular panels comprising:

a base section having an inside edge and an outside edge and two side edges; and a side section having a top edge and a bottom edge and two side edges;

wherein said base section and side section being fixedly connected to one another at the bottom edge of the side section and the outside edge of the base section and comprising a plurality of rib elements bridging the side section and base section.

Preferably, the basin comprising straight modular panels and corner modular panels. Also preferably, each one of said rib elements having a hollow back portion to allow for the interlocking of two panels together.

According to another aspect of the present invention, there is provided a containment basin comprising an access port is located on the side section of the modular panel, said access port adapted to allow the removal of material located inside the containment basin. Preferably, the access port being located centrally to the side section. Also preferably, the corner modular panel having a first extremity comprising a rib adapted to be inserted into a rib of a straight modular panel.

BRIEF DESCRIPTION OF THE FIGURES

The invention may be more completely understood in consideration of the following description of various embodiments of the invention in connection with the accompanying figures, in which.

DETAILED DESCRIPTION OF A PREFERRED EMBODIMENT OF THE INVENTION

Figure 1:
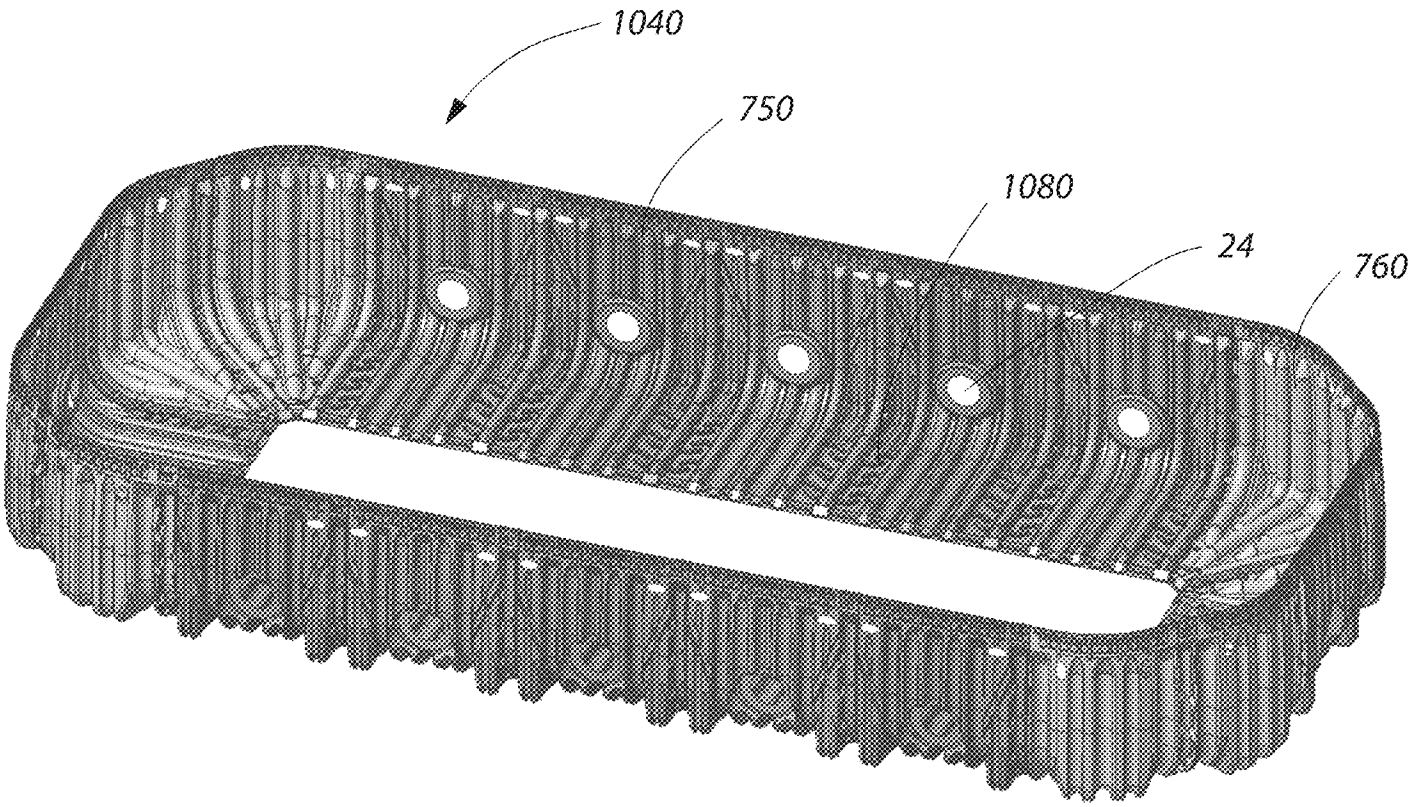
FIG. 1 is a perspective view of a containment basin comprising modular panels according to a preferred embodiment of the present invention.
Figure 2:
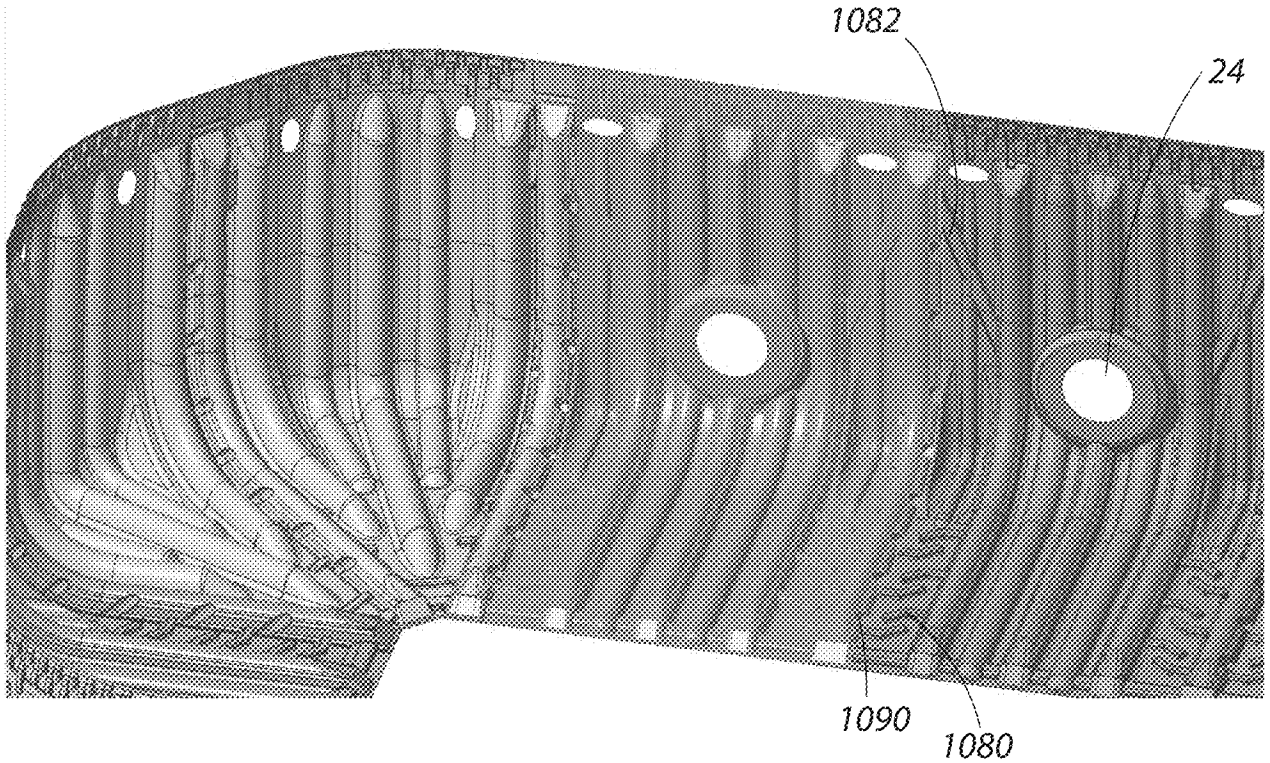
FIG. 2 is a close-up view of the corner of a containment basin comprising modular panels according to a preferred embodiment of the present invention.
Figure 3:
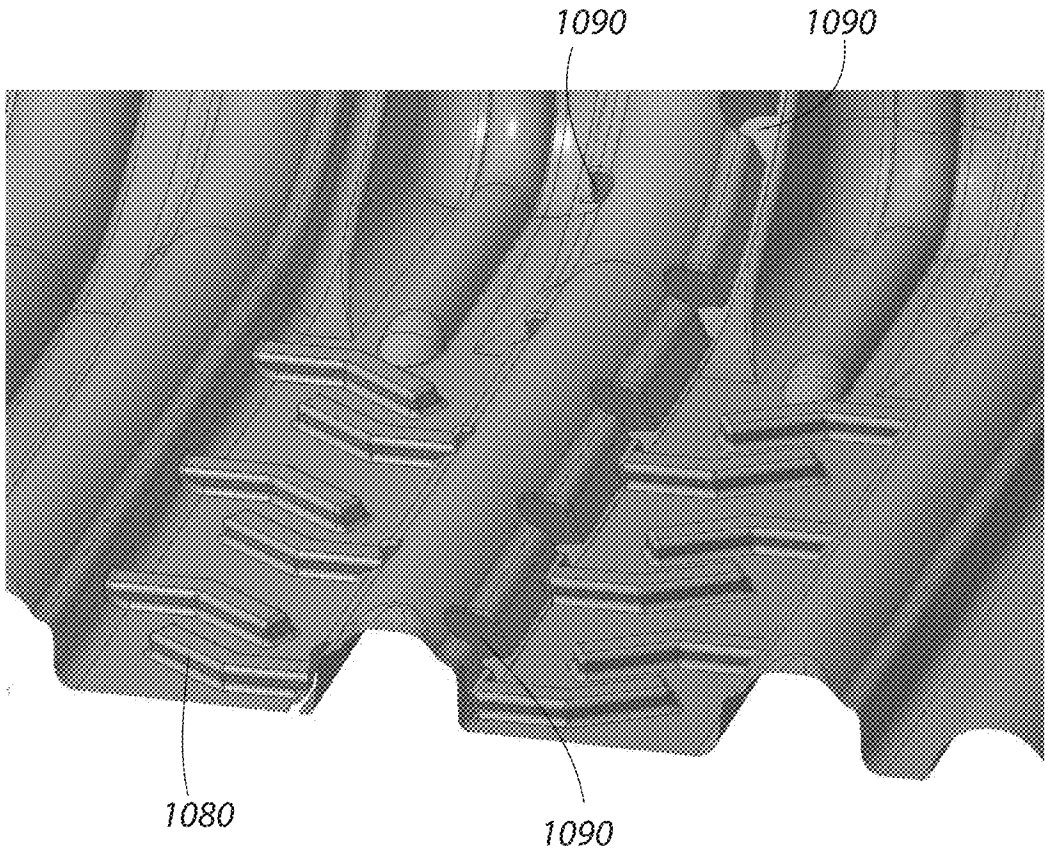
FIG. 3 is a close-up view of two modular panels nested according to a preferred embodiment of the present invention.
Figure 6:
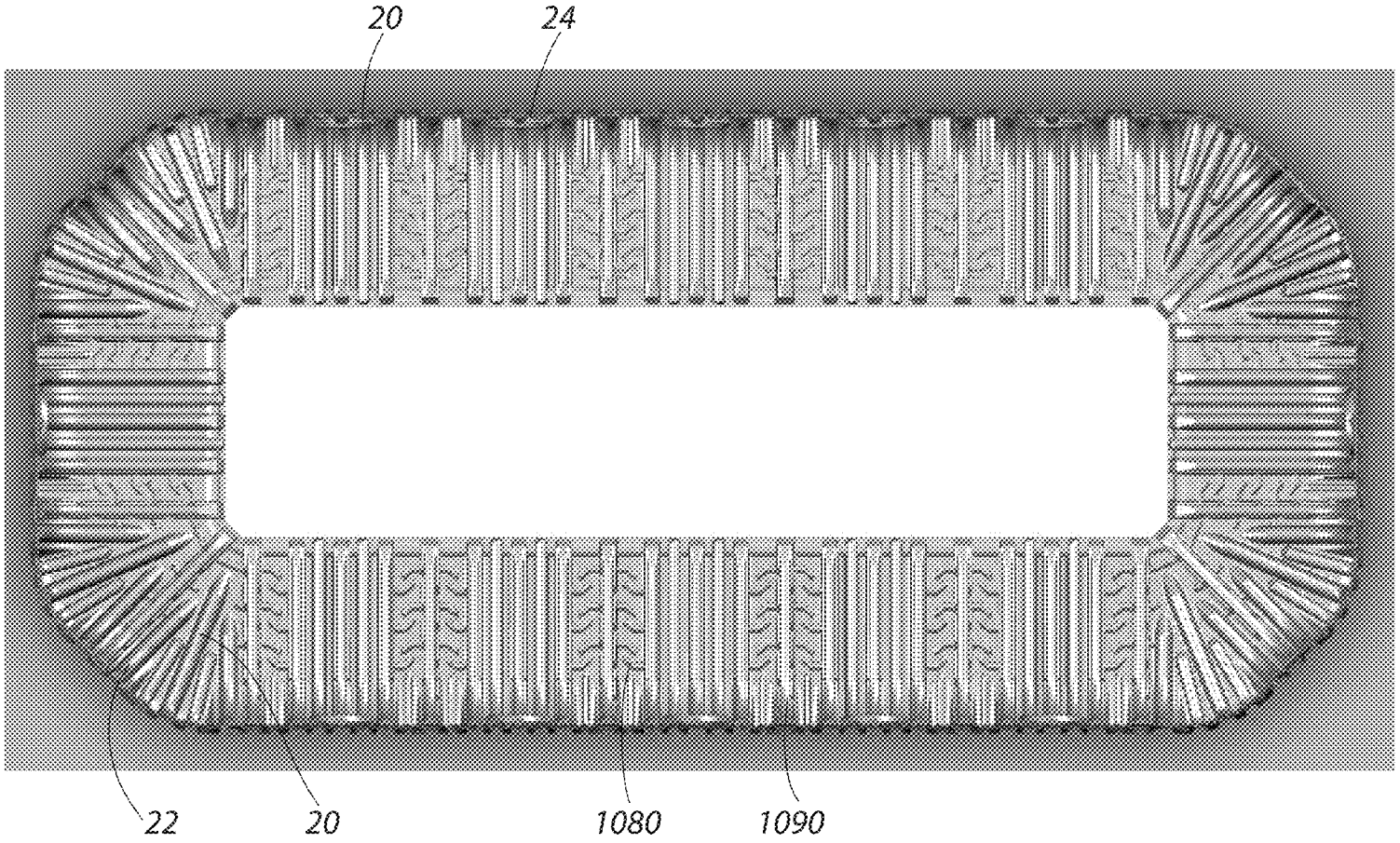
FIG. 6 is a underneath view of a containment basin comprising modular panels according to a preferred embodiment of the present invention.

A containment basin according to a preferred embodiment of the present invention as illustrated in FIGS. 1, 2 and 6 depict a modular panel based-containment basin which requires no hand tools or mechanical devices to be used for the installation thereof. The design is based on a parallelogram centralizing the load to keep the centre of gravity low. The strength of the structure was designed into the panel construction to keep the panels in place with the load of the fluid as well as the block design holds each panel to the other panel. The metal top ring ties the top of the panels together and is an integral part of the design. Once the system is installed the structure is entirely free standing and requires no additional support legs, bolts, tension wires or cables. The block design and hydrostatic pressure holds the system firmly in place. The rigidity of the panel comes from the one-piece design with the support ribs molded into the panel. According to a preferred embodiment as seen in FIGS. 1, 2, 3 and 4, there are structural integrity enhancement ribs located proximate each side edge (16, 16') of the base section (12) of a straight/side panel (750). These integrity enhancement ribs (1080) help in preventing the panel base edges from warping and therefore provide integrity to a fully assembled containment basin (1040).

This system is design to go around a tank/vessel to prevent the potential of the fluids in which were being stored in the tank/vessel from leaking and contaminating the ground or surrounding area. Inside of the containment a plastic linear will be installed to contain the fluids. This method of linear is used on a regular basis with the competitors.

According to a preferred embodiment of the present invention, the fluid containment basin is designed out of 100% plastic and can also be made out of recycled plastic. Preferably, the plastic used for the manufacturing of the modular panels is high-molecular weight polyethylene. Unlike, ABS which becomes more brittle at very cold temperatures and may shatter like glass under such conditions, HMWPE is desirable for the manufacturing of the panels. It can also be made from appropriate recycled plastic. Ideally, talc is added to the HMWPE during the manufacturing in order to increase the heat rating of the plastic. Preferably, between 7 and 14 per weight % of talc is added to the plastic prior to moulding. According to a preferred embodiment of the present invention, the modular panels made of high-molecular weight polyethylene (HMWPE) are adapted to withstand temperatures ranging from −40° C. to 40° C. This renders them usable in oil industry hotspots such as Texas (with very high temperatures) and Northern Alberta (Edmonton) (which has very cold winter temperatures during the winter).

Figure 5:
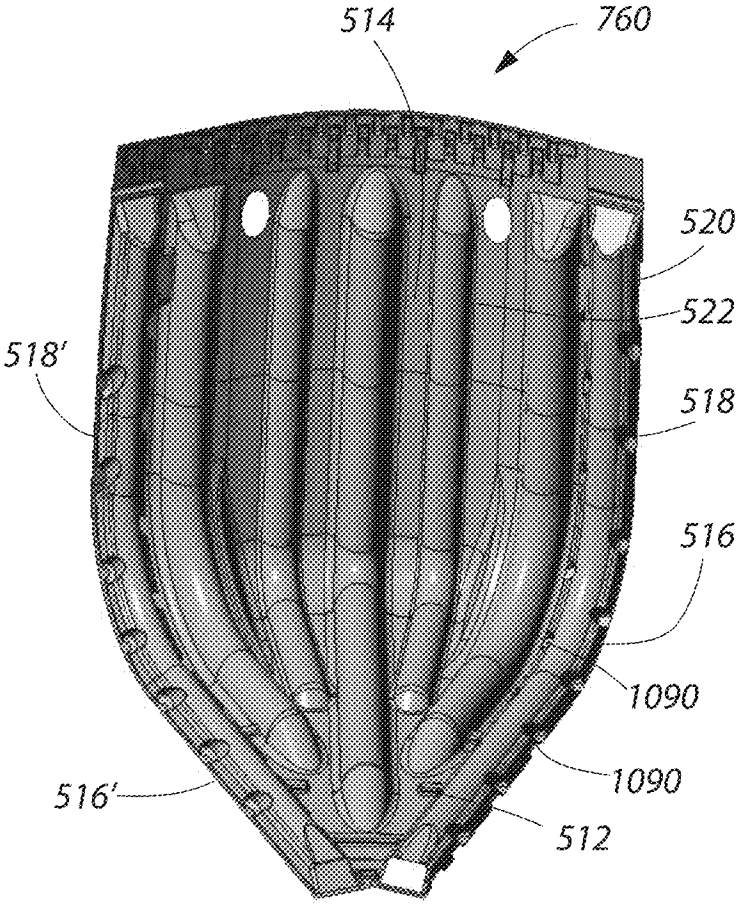
FIG. 5 is a front view of a side modular panel according to a preferred embodiment of the present invention.
Figure 4:
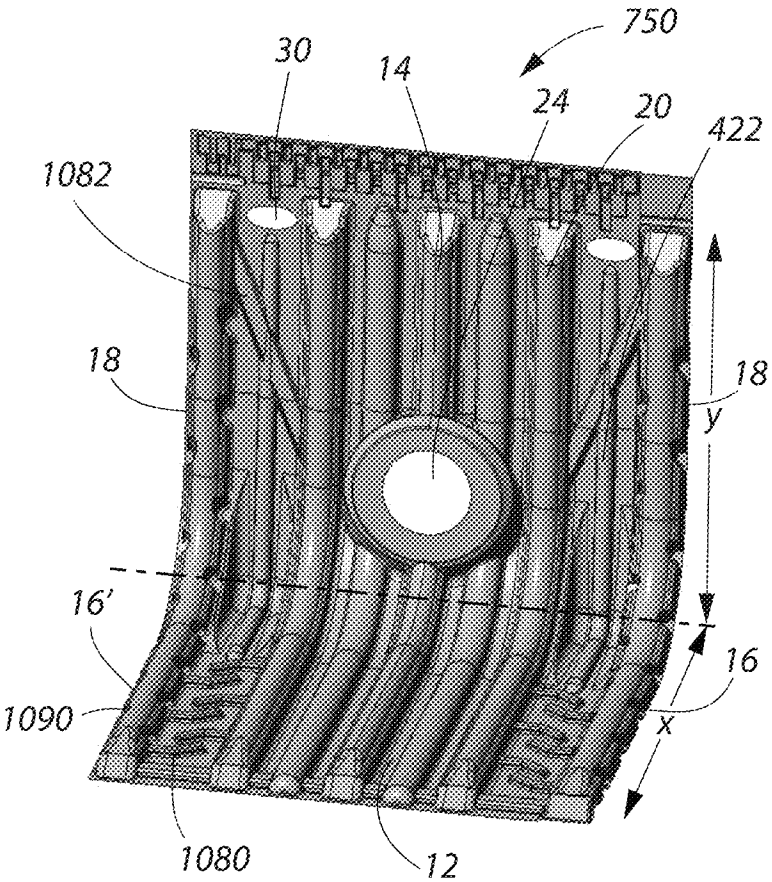
FIG. 4 is a front view of a corner modular panel according to a preferred embodiment of the present invention.

As seen in FIGS. 4 and 5, the shape and the design of the ribs (20, 422 and 522) is preferably arcuate and is based on the math of the fluid weight and pressure it exerts on the containment basin sides. The rib elements (20, 22) preferably have an inwardly arcuate shape which tapers out proximate each extremity of the base section (12) and side section (14) of the straight modular panels (750) as well as that of the corner panel (760). The extremities of the ribs (20) are substantially located proximate the edge of the sections it supports (side section and base section).

As seen in FIG. 4, a straight panel (750) according to a preferred embodiment of the present invention, has a base section (12) attached to a side section (14) connected together along a longitudinal axis. Said panel further comprises larger ribs (20) and shorter ribs (422) and a handle (30) proximate the top edge of the side section for manual carrying of the panel (10). The length of the larger ribs (20) on the base section (12) being identified as being of length X and the length of the larger ribs (20) on the side section (14) being identified as being of length Y. The base section (12) comprising edges (16 and 16') and the side section (12) comprising similar edges (18 and 18') as well as an access port (24).

As seen in FIG. 5, a corner panel (760) according to a preferred embodiment of the present invention, has a base section (512) attached to a side section (514) connected together along a longitudinal axis. Said panel further comprises larger ribs (520) and shorter ribs (not labeled) and a handle (30). The length of the larger ribs (520) on the base section (512) being identified as being of length X and the length of the larger ribs (520) on the side section (514) being identified as being of length Y. The base section (512) comprising edges (516 and 516') and the side section (512) comprising similar edges (518 and 518'). It is preferable to avoid access ports on corner pieces, but it is not entirely forbidden.

Preferably, a plurality of rib elements is located along the entire length of a straight panel. More preferably, each one of the plurality of rib elements is positioned at an equal distance from one another along a longitudinal axis defined by the panel.

More preferably, the plurality of rib elements is comprised of larger ribs interspersed between similarly shape smaller/shorter ribs. This design allows to provide the functional strength required by the modular panel all the while decreasing the weight of the panel in comparison to a panel solely comprising larger ribs.

According to a preferred embodiment of the present invention, the modular panels do not require post, legs or separate support beams or the like to remain standing. The present invention provides for free-standing modular panels for use in erecting a containment basin (1040) as illustrated in FIGS. 1 and 6 and partially seen in FIG. 2. The access ports (24) are visible and are present on every straight modular panel piece (750) and not found on the corner pieces (760). In this embodiment, two corner pieces (760) are required to make a 90-degree corner, however in another embodiment such a corner can be made out of a single piece.

FIG. 1 shows a large containment basin (1040) using the same principles described hereinabove where the length of the basin is made up of 5 straight panels (750) and the width is made up of a single straight panel and the corners are each made with two corner panels (760).

Upon closer inspection of FIGS. 2, 3, 4 and 5, various panel reinforcement features become evident. Cross-braces (1082) are located proximate each edge of the side section of a straight panel. A plurality of structural integrity enhancement ribs (1080) are located on the base section stemming in an alternating pattern from the last large rib and the second-to-last large rib. Each one of the plurality of structural integrity enhancement ribs (1080) is intended on providing support to prevent the base section of warping in use prior to packing in the basin with materials such as sand or gravel. Each one of the plurality of structural integrity enhancement ribs (1080) juts perpendicularly out from the large rib to a point which is roughly one third of the distance between each rib and slightly curves away from the perpendicular. The same pattern in opposition direction is maintained for ribs (1080) jutting out from the second-to-last rib save for the fact that, at the deflection point, the ribs (1080) curve in the opposite direction, thus creating parallel ribs (1080) sections. The person skilled in the art will understand that other patterns are also understood to be within the scope of this feature of the present invention without departing from the scope thereof. To further enhance the stability of the containment basin made of the modular panels and the strength of the connections between adjacent panels, each panel optionally comprises a plurality of indentations on the outermost rib on either edge (16, 16' and 18, 18'). These indentations (1090) are staggered but adapted to be inserted into the indentations located the ribs of an adjacent panel when the outermost ribs of adjacent panels are overlapped upon installation. According to a preferred embodiment of the present invention, the indentations (as seen in FIGS. 4 and 5) are perpendicular with the panel on the base section (12 and 512, respectively) but have an angle when located along the side section of the panels (14 and 514, respectively for the straight and the corner panels). This facilitates the installation of the panels by first inserting the indentation on the base section of the panels and then sliding the indentations on the side panels into each other with a downward motion. Preferably, the plurality of indentations located along an outermost rib on each edge of said panel, each one of a plurality of indentations adapted to be inserted into complementary indentations located on the outermost rib of an adjacent panel upon installation.

As seen in FIG. 1, according to a preferred embodiment, the modular panels have a built-in inward inclination. Preferably, the angle of the inward inclination is about 2-3 degrees from the perpendicular (or more specifically, the angle between the base section and the side section is about 87-88 degrees. This inward inclination of the side panel provides for increased structural strength, and weight resistance. As the loads to be retained can be quite large it is desirable to have a structure which allow for some movement without sacrificing the integrity of the individual panels of the entire structure. The concept is similar to flatbed trucks which have an arched bed to allow large loads without the bed collapsing downwards below the plane. When weight from the load pushes the trailer flat the built-in arch proves resistance. According to a preferred embodiment, the built-in inclination is considered in the manufacturing step of the panels, to allow for some movement of the side section outwardly without breaking the connection between adjacent panels.

As these containment basins are exposed to rainfalls, it is desirable to have a method of monitoring the basins before, during or after substantial rains in order to assure that there is no liquid overflow of the basin and subsequent potential loss of hydrocarbon material onto the unprotected ground. The access ports can be used to drain out the water from a containment basin by opening them and draining them into appropriate containers to further process the liquids collected from the containment basin, if need be. If one can determine that the only liquid being drained out of the containment basin is water (from the rain for example), one can choose to dump the liquid next to the basin or at another predetermined location without the need for any processing to remove oils or other contaminants.

According to a preferred embodiment of the present invention, upon installation of a containment basin, the modular panels are laid down on a level surface in such a way as to overlap adjacent panels by inserting at least one rib element over the rib element of the previously laid modular panel. This process is repeated until the entire containment basin has been set up. Next, a layer of plastic cover is laid over the surface of the containment basin ensuring that the base section of each modular panel is fully covered and that the plastic cover goes up the side of the side sections of the modular panels. Once this step is completed, the containment is back filled with sand, gravel or a similar granular material. The weight of this granular material pushes down on the modular panels but also puts pressure on the side sections of the modular panels. The rib elements are designed to maintain the integrity of the modular panels all the while overcoming the need to have posts or legs or the like to maintain the panels upright when the containment basin is in use.

According to a preferred embodiment of the present invention, the modular panels can have handles proximate a top edge of the side sections in order to allow a user to carry the modular panels. According to another preferred embodiment of the present invention, both the side section and bottom section are identical and the handles are found on both sections.

According to another preferred embodiment of the present invention, a containment basin kit comprises modular panels for straight pieces as shown in FIG. 4 as well as corner pieces as shown in FIG. 5. The corner sections comprise a similar design as the straight sections and have a similar edge rib elements pattern adapted to overlap at one end with a first straight section and at the other end with another straight section. More preferably, the corner sections comprise two pieces, a first piece which overlaps with a first straight piece at one extremity thereof and is being overlapped by a section corner piece at its other extremity. The second corner piece is then overlapped by a second straight piece, thus completing the corner.

In use, the modular panels assembled together have an overlap of a first panel with an adjacent second panel by overlapping at least one rib element from each of the adjacent panels. This interlocking feature allows for a strong, secure and removable connection between adjacent panels. The connection is made even stronger once the containment basin is filled with filling material such as sand or gravel or the like. Therefore, the present invention circumvents the need for bolts, pins, cables or anything to hold the panels of the containment basin together. Nor is there a need for legs or external supports to support the containment basin made of the modular panels according to the present invention as it is entirely free standing. The system is entirely self-supporting.

An advantage of a preferred embodiment of the present invention, is that it allows the modular panels to be packed extremely tightly as they are also lightweight.

While the foregoing invention has been described in some detail for purposes of clarity and understanding, it will be appreciated by those skilled in the relevant arts, once they have been made familiar with this disclosure that various changes in form and detail can be made without departing from the true scope of the invention in the appended claims.

The invention claimed is:

1. An interlocking modular panel for use in a containment basin, wherein said modular panel comprises:

a base section;

a side section; and wherein said base section and said side section are molded together as a single unitary piece and are fixedly connected to one another at an edge and said interlocking modular panel further includes a plurality of ribs molded thereinto, said ribs bridging said side section and said base section.

2. The interlocking modular panel of claim 1, wherein each of one said plurality of ribs extends from said side section down to said base section.

3. The interlocking modular panel of claim 1, wherein each one of said plurality of ribs are substantially perpendicular to said edge.

4. The interlocking modular panel of claim 1, wherein each one of said plurality of ribs have an inward arcuate shape and each one of said plurality of ribs extend from a distance Y from said edge on said side section down to a distance X from said edge on said base section.

5. The interlocking modular panel of claim 4, wherein the length of distance Y is substantially equal to the length of distance X.

6. The interlocking modular panel of claim 1, further comprising a plurality of shorter ribs, wherein each one of said plurality of shorter ribs is positioned between two adjacent ribs of said plurality of ribs in an alternating pattern.

7. The interlocking modular panel of claim 6, wherein each one of said plurality of shorter ribs has an inward arcuate shape and each one of said plurality of shorter ribs extends from a distance Y2 from said edge on said side section down to a distance X2 from said edge on said base section.

8. The interlocking modular panel of claim 7, wherein the length of distance Y2 is substantially equal to the length of distance X2.

9. A containment basin comprising:

a plurality of interlocking modular panels forming a perimeter around a storage tank, wherein said each one of said modular panels includes: (i) a base section having an inside edge, an outside edge and two side edges; (ii) a side section having a top edge, a bottom edge and two side edges;

wherein said base section and side section are molded together as a single unitary piece and fixedly connected to one another at said bottom edge of the side section and said outside edge of the base section; and a plurality of ribs molded thereinto, said ribs bridging said side section and said base section.

10. The containment basin of claim 9, wherein said plurality of interlocking modular panels include straight modular panels and corner modular panels.

11. The containment basin of claim 9, wherein each one of said ribs has a hollow back portion to allow for interlocking of adjacent interlocking modular panels together.

12. The containment basin of claim 9, further comprising an access port located on said side section and said access port adapted to allow removal of material located inside said containment basin.

13. The containment basin of claim 9 wherein said access port is located centrally to said side section.

14. The containment basin of claim 10 wherein said corner modular panels have a first extremity comprising a rib adapted to be inserted into a rib of a straight modular panel.

15. An interlocking modular panel for use in a containment basin comprising:

a base section;

a side section;

wherein said base section and side section are molded together as a single unitary piece and are fixedly connected to one another at an edge; and said interlocking modular panel further includes a plurality of ribs molded thereinto, said ribs bridging said side section and said base section, where said side section has an inward inclination of at least 2 degrees from a perpendicular.

16. The interlocking modular panel of claim 15 further comprising a plurality of indentations located along an outermost rib on each edge of said modular panel, each one of said plurality of indentations adapted to be inserted into corresponding indentations located on an outermost rib of an adjacent modular panel.

* * * * *